United States Patent [19]

Rowe

[11] Patent Number: 4,911,076

[45] Date of Patent: Mar. 27, 1990

[54] TIME DELAY REPLAY

[75] Inventor: Anthony J. Rowe, Edenvale, South Africa

[73] Assignee: AECI Limited, Johannesburg, South Africa

[21] Appl. No.: 268,691

[22] Filed: Nov. 8, 1988

[30] Foreign Application Priority Data

Nov. 11, 1987 [ZA] South Africa ..... 87/8476

[51] Int. Cl.[4] ..... C06C 5/04; F42B 3/16

[52] U.S. Cl. ..... 102/275.3; 102/275.4

[58] Field of Search ..... 102/275.3, 275.4, 275.7, 102/275.12, 275.2, 275.11, 275.1

[56] References Cited

U.S. PATENT DOCUMENTS

| | | | |
|---|---|---|---|
| 2,618,221 | 11/1952 | Lowe | 102/275.4 |
| 2,707,438 | 5/1955 | Mann et al. | 102/275.3 |
| 3,306,201 | 2/1967 | Noddin | 102/275.3 |
| 3,343,487 | 9/1967 | Hare et al. | 102/275.3 |
| 3,727,552 | 4/1973 | Zakheim | 102/275.3 |
| 4,248,152 | 2/1981 | Yunan | 102/275.4 |
| 4,424,747 | 1/1984 | Yunan | 102/275.3 |
| 4,426,933 | 1/1984 | Yunan | 102/275.3 |
| 4,495,867 | 1/1985 | Mitchell et al. | 102/275.4 |
| 4,714,017 | 12/1987 | Kelly et al. | 102/275.3 |
| 4,730,560 | 3/1988 | Bartholomew et al. | 102/275.3 |
| 4,742,773 | 5/1988 | Bartholomew et al. | 102/275.3 |

FOREIGN PATENT DOCUMENTS

| | | | |
|---|---|---|---|
| 592057 | 2/1960 | Canada | 102/275.3 |

*Primary Examiner*—David H. Brown

*Attorney, Agent, or Firm*—Cushman, Darby & Cushman

[57] ABSTRACT

A detonating delay relay for shock or signal tube application so made as to be bidirectional. Comprising a delay detonator having a plug which holds two lengths of shock tube sealed at the ends. The detonation pulse is transmitted from one length of shock tube to the delay detonator. After a suitable delay, initiation of the other length of shock tube takes place.

4 Claims, 1 Drawing Sheet

TIME DELAY REPLAY

Figure 1:
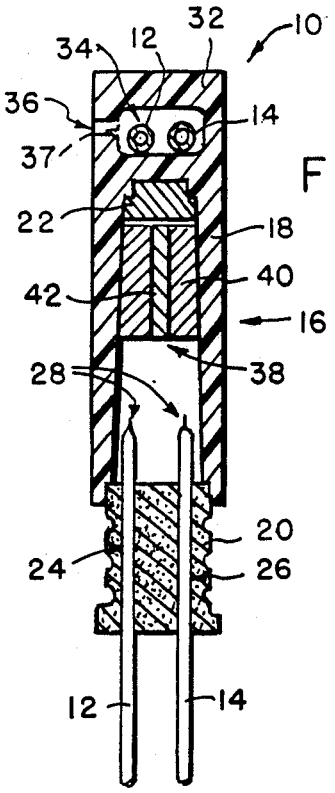

This invention relates to a time delay relay for use with a low energy shock tube in the detonation of explosives. More particularly it relates to such time delay relay for use in transmitting, after a time delay, a detonation in a low energy shock tube to another low energy shock tube.

According to the invention there is provided a time delay relay for use in transmitting, after a time delay, a detonation in a length of low energy shock tube to another length of low energy shock tube, the relay comprising a time delay detonator initiable by a low energy shock tube, one length of low energy shock tube connected at an end thereof to the detonator such that transmission of a detonation along said one length of shock tube to the detonator initiates, after a delay, detonation of the detonator, and another length of low energy shock tube connected at an end thereof to the detonator such that detonation of the detonator initiates a detonation in the other length of shock tube which is transmitted along the other length of shock tube away from the detonator.

The delay detonator may be similar to delay detonators typically initiated by said shock tubes. The time delay detonator may thus comprise an outer housing, containing an explosive base charge and containing a delay element adjacent the base charge, said one length of shock tube leading into the housing so that said end of the one length of shock tube is located in the housing and is separated from the base charge by the delay element. The housings of such detonators are usually in the form of metal or plastic tubes and the delay element, which may be alongside or spaced from the base charge, in use initiates the base charge, either directly of indirectly via a primer or booster charge sandwiched between the delay element and base charge. In this construction said one length of shock tube is conveniently arranged so that its said end is directed at the delay element so that in use a detonation issuing from said end will impinge on and initiate the delay element at a position remote from the base charge. The other length of shock tube will, as mentioned above, be connected to the detonator at a position such that detonation of the detonator will initiate a detonation in said other length.

As indicated above, the detonator may include a primer or booster charge between the base charge and the delay element.

In one embodiment, the housing may be tubular, having a closed end and an open end, the base charge being located at or adjacent the closed end of the housing and the delay element being located in the housing between the base charge and the open end of the housing, said one length of shock tube leading into the housing via a passage in a closure which closes the open end of the housing. In a refinement of this embodiment the detonator may have a cup-shaped plastics housing at the blind or inner closed end of which the base charge, which may be lead styphnate, lead azide or the like, is located, the delay element being located alongside the base charge and in contact therewith, and said one length of shock tube entering the mouth of the cup via a passage in a closure in the form of a plug or stopper which closes said mouth, the end of said one length in the housing being directed axially at the delay element.

A sealer element comprising an incendiary material which leaves solid oxide residue when it is burned may be provided on the side of the delay element remote from the base charge, between the delay element and said one length of shock tube.

The detonator may comprise tube holding means, said other length of shock tube being connected to the housing by the tube holding means at a position outside and abutting the housing and adjacent the base charge. The tube holding means may be a clip integral with the housing, the tube holding means projecting from the closed end of the housing, the clip being axially aligned with the housing and holding said other length of shock tube in a position abutting the closed end of the shock tube and axially aligned therewith. This clip tube holding means is suitable for a plastics housing of the type described above and the clip can be moulded integrally with the housing. Instead the tube holding means may encircle the housing intermediate its ends and alongside the base charge, said other length of shock tube being connected to the housing by the holding means in a position abutting the housing alongside the base charge.

In another embodiment of the invention, the detonator may have a cup-shaped metal housing containing the base charge at its inner or blind closed end, the delay element being alongside the base charge or optionally spaced therefrom by a primer or booster charge. In this case the base charge may be a high explosive such as pentaerythritol tetranitrate (PETN), the primer being lead styphate, lead azide or the like. In this embodiment also, the one length of shock tube may enter the cup via a passage in a plug or stopper which closes the mouth of the cup. In this embodiment a sealer element of the type described above is expected to be useful; and the other length of shock tube may be held alongside the detonator cup in contact therewith by holding means of the type described above which encircles the housing.

Said lengths of shock tube may each be connected to the detonator in substantially the same fashion such that a detonation transmitted along either length of shock tube to the detonator, initiates, after a delay, detonation of the detonator, and so that detonation of the detonator initiates a detonation in the remaining length, which detonation is transmitted away from the detonator, both lengths of shock tube having their ends which are connected to the detonator sealed. Thus, in both of the above embodiments, in a preferred form of the invention, both lengths of shock tube may enter the cup via respective passages in the stopper or plug, being arranged so that a detonation issuing from either thereof can initiate the delay element, either directly or via said seal element. In this case the ends of the shock tubes in the cup are sealed, so that whichever length of shock tube initiates the detonator, the remaining length will not be initiated upstream of the delay element, so that short-circuiting of the delay element will be prevented. In this case both lengths of shock tube will be connected to the detonator, e.g. by the holding means described above, in positions where either can be initiated by detonation of the detonator. Thus, either length of shock tube can be used to detonate the other via the delay element, so that the relay is bidirectional and reversibly connectable in use to two shock tubes which are to be connected together by the relay.

In this regard it will be appreciated that the two lengths of shock tube which form part of the relay will be relatively short and will have free ends for connection to two shock tubes which are to be connected together by the relay.

Figure 2:
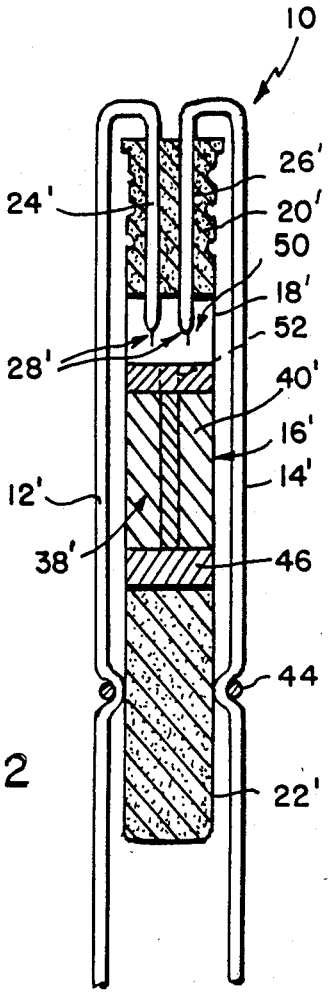

The invention will now be described by way of example with reference to the accompanying diagrammatic drawings, in which:

FIG. 1 shows a schematic sectional side elevation of a time delay relay according to the invention; and FIG. 2 shows a similar view of another relay according to the invention.

In the drawings, reference numerals 10,10' generally designate time delay relays for use in transmitting, after a time delay, a detonation in a length 12,12' of low energy shock tube to another length 14,14' of low energy shock tube.

In addition to the lengths 12 or 12', 14 or 14' of shock tube, the relays 10,10' each comprise a detonator, generally designated 16,16'. Each detonator 16,16' comprises a cup-shaped housing 18,18' whose mouth is closed by a plastics or elastomeric plug 20,20' and which contains a base charge 22,22' at its inner or blind end. The tubes 12 or 12', 14 or 14' pass through respective passages 24 or 24', 26 or 26' therefor in the plug 20, 20' into the cup or housing 18,18'. The free ends of the tubes 12 or 12', 14 or 14' in the housing 18, 18' are sealed as at 28,28'.

With particular reference to FIG. 1, the housing 18 is a plastics moulding and is moulded to have a clip 30 formed integrally therewith, outside and axially aligned with its blind end. The clip 30 comprises a limb 32 which defines a slot 34 having a narrow entry 36. The entry 36 is narrower than the tubes 12, 14 which can be pressed therethrough into the slot 34, as shown in FIG. 1, each tube being looped around (not shown) to pass through the slot 34 and then into the cup 18 via the plug 20.

In FIG. 1 the base charge 22 is lead styphnate or lead azide, and a delay element 38 comprising a metal sleeve 40 having an incendiary core 42 is provided in the cup 18 in close proximity to the base charge 22. The free ends of the tubes 12, 14 inside the cup, are directed towards the delay element 38.

Turning to FIG. 2, the housing 18' is of metal and is crimped to the plug 20', unlike FIG. 1 where the plug 20 is shown as a frictional fit in the cup mouth, although, if desired, the plug 20 may in FIG. 1 be retained in the mouth of the housing by a metal ferrule which is fitted and crimped over said plug and housing. The tubes 12', 14' are held up against the part of the detonator 16' comprising the base charge 22', by holding means, illustrated in FIG. 2 by an elastic rubber band 44.

In FIG. 2 the base charge 22' is PETN and a primer or booster charge 46 of lead azide or lead styphate is shown against the base charge 22'. A delay element 38', 40', 42' (of the same construction as shown in FIG. 1) is provided on the opposite side of the primer 46 from the base charge 48; and, on the side of the delay element 48 opposite the primer 46, is shown a sealer element 50. The sealer element 50 comprises a metal annulus 52 having a core 54 of incendiary material which leaves a solid oxide residue when it is burnt. The sealed ends 28' of the tubes 12', 14' are directed towards the sealer element 50.

In a variation of the relay of FIG. 1, the entry 36 may be closed as shown in broken lines at 37, so that the tubes 12, 14 are threaded into the slot 34 rather than pressed into it.

In use the tubes 12, 44 will form extensions of lengths of low energy shock tube, such as NONEL shock tubing available in South Africa from the Applicant, or will be connected thereto by suitable in-line connectors (the tubes 12, 14 accordingly also being NONEL tubes), in situations where the one length of tube is to be initiated by the other after a predetermined time delay.

In FIG. 1, a detonation passing along either tube 12, 14 will issue from its sealed end 28 and will initiate the core 42 of the delay element 38. After the prescribed delay, the core 42 will burn through to the base charge 22 which will be initiated thereby, the base charge in turn detonating and initiating a detonation in the other tube 12, 14, where it is held by the clip 30. The sealed end 28 of said other tube prevents the detonation which issues into the detonator 16 from the upstream tube from short-circuiting the delay element 38.

In FIG. 2 the operation is broadly similar. However, in this case the sealer element 50 is first initiated by the detonation issuing from the upstream tube 12', 14' into the detonator. The core 54 of the sealer element 50 burns through and initiates the core 42 of the delay element 38, which in turn burns up to the primer 46 which it initiates, the primer detonating and thus initiating a detonation of the base charge 22. The base charge finally upon detonation thereof initiates a detonation in the other tube 12, 14. With regard to the sealer element 50 it should be noted that its core 54 upon burning leaves a solid oxide residue behind which effectively seals off the delay element 38, primer 46 and base charge 22 from the tube 12, 14. This prevents or reduces loss of gases from the detonator 16' into the free end of the upstream tubes 12', 14', which was previously sealed at 28 but which is blown open by the detonation issuing therefrom into the detonator 16'. This prevents a pressure drop in the detonator 16' which could otherwise adversely affect the burning speed of the delay composition. The provision of a sealer element is naturally, as indicated above, optional.

It is an advantage of the invention that it provides a robust simple time delay relay which makes use of a substantial number of unexpensive standard detonator components. It is a particular advantage of the invention as illustrated in the drawings that it provides a bidirectional relay , in which either of the tubes 12, 14 can be connected on the upstream side of the delay element, so that there is no danger of connecting it in-line the wrong way round.

I claim:

1. A time delay relay for use in transmitting, after a time delay, a detonation in a length of low energy shock tube to another length of low energy shock tube, the relay comprising:

a time delay detonator, of the type initiable by a low energy shock tube, a first length of low energy shock tube, having an end thereof connected to the detonator, such that transmission of a detonation along said first length of shock tube to the detonator initiates detonation of the detonator, and an other length of low energy shock tube having an end thereof connected to the detonator such that detonation of the detonator initiates a detonation in the other length of shock tube which is transmitted along the other length of shock tube away from the detonator, in which the time delay detonator comprises an outer housing including an explosive base charge and a time delay element, said first length of shock tube leading into the housing so that said end of the first length of shock tube is located in the housing and is separated from the base charge by the delay element, in which the housing is tubular, having a closed end and an open end, the base charge being located at or adjacent the closed end of the housing and the delay element being located in the housing between the base charge and the open end of the housing, said first length of shock tube leading into the housing via a passage in a closure which closes the open end of the housing, and in which a sealer element comprising an incendiary material which leaves a solid oxide residue when it is burned is provided on a side of the delay element remote from the base charge, between the delay element and said first length of shock tube.

2. A time delay relay for use in transmitting, after a time delay, a detonation in a length of low energy shock tube to another length of low energy shock tube, the relay comprising:

a time delay detonator, of the type initiable by a low energy shock tube, a first length of low energy shock tube, having an end thereof connected to the detonator, such that transmission of a detonation along said first length of shock tube to the detonator initiates detonation of the detonator, and an other length of low energy shock tube having an end thereof connected to the detonator such that detonation of the detonator initiates a detonation in the other length of shock tube which is transmitted along the other length of shock tube away from the detonator, in which the time delay detonator comprises an outer housing including an explosive base charge and a time delay element, said first length of shock tube leading into the housing so that said end of the first length of shock tube is located in the housing and is separated from the base charge by the delay element, in which the housing is tubular, having a closed end and an open end, the base charge being located at or adjacent the closed end of the housing and the delay element being located in the housing between the base charge and the open end of the housing, said first length of shock tube leading into the housing via a passage in a closure which closes the open end of the housing, and in which the detonator comprises tube holding means, said other length of shock tube being connected to the housing by the tube holding means at a position outside and abutting the housing and adjacent the base charge.

3. A relay as claimed in claim 2, in which the tube holding means is a clip integral with the housing and projects from the closed end of the housing, the clip being axially aligned with the housing and holding said other length of shock tube in a position abutting the closed end of the shock tube and axially aligned therewith.

4. A relay as claimed in claim 2, in which the tube holding means encircles the housing intermediate its ends and alongside the base charge, said other length of shock tube being connected to the housing by the holding means in a position abutting the housing alongside the base charge.

* * * * *